United States Patent [19]

Sausner

[11] Patent Number: 4,753,393

[45] Date of Patent: Jun. 28, 1988

[54] ELECTROMAGNETICALLY ACTUATABLE FUEL-INJECTION VALVE

[75] Inventor: Andreas Sausner, Frankfurt am Main, Fed. Rep. of Germany

[73] Assignee: VDO Adolf Schindling AG, Frankfurt am Main, Fed. Rep. of Germany

[21] Appl. No.: 923,972

[22] Filed: Oct. 28, 1986

[30] Foreign Application Priority Data

Nov. 4, 1985 [DE] Fed. Rep. of Germany ..... 3539056

[51] Int. Cl.[4] ..... B05B 1/34

[52] U.S. Cl. ..... 239/467; 239/483; 239/590.5

[58] Field of Search ..... 239/585, 463, 464, 465, 239/467, 476, 482, 483, 533.12, 590.5

[56] References Cited

U.S. PATENT DOCUMENTS

| | | | |
|---|---|---|---|
| 2,308,909 | 1/1943 | Blanchard | 239/482 |
| 3,705,692 | 12/1972 | Garnier | 239/585 |
| 4,232,830 | 11/1980 | Casey et al. | 239/585 |
| 4,421,278 | 12/1983 | Kienzle et al. | 239/533.12 |

FOREIGN PATENT DOCUMENTS

| | | | |
|---|---|---|---|
| 3502086 | 7/1986 | Fed. Rep. of Germany | 239/585 |
| 62358 | 4/1983 | Japan | 239/585 |
| 263835 | 5/1927 | United Kingdom | 239/533.12 |
| 2080415 | 2/1982 | United Kingdom | 239/585 |

*Primary Examiner*—Andres Kashnikow
*Assistant Examiner*—Michael J. Forman
*Attorney, Agent, or Firm*—Martin A. Farber

[57] ABSTRACT

In an electromagnetically actuatable fuel-injection valve for injection systems for internal-combustion engines, the valve includes a valve housing, an ejection opening, a magnet winding, a closure element which is connected to an armature associated with the magnet winding, and a pin which is located in the ejection opening and has a conical region, the conical region being within or at a plane formed by the outer edge of the ejection opening. In this way, the formation of drops at the edge of the ejection opening is prevented so that a fine atomization is obtained.

6 Claims, 2 Drawing Sheets

ELECTROMAGNETICALLY ACTUATABLE FUEL-INJECTION VALVE

FIELD AND BACKGROUND OF THE INVENTION

The present invention relates to an electromagnetically actuatable fuel-injection valve for injection systems for internal-combustion engines, having a valve housing, an ejection opening, a magnet winding, a closure element which is connected to an armature associated with the magnet and a pin which is disposed in the ejection opening, the pin having a conical region.

For the combustion process in internal-combustion engines a well atomized fuel is particularly important. Fuel-injection valves are already known in which a swirl chamber is provided into which the fuel is introduced tangentially in order to improve the atomization. The maintaining of the swirl is supported within the ejection opening by a pin-like extension of the injection needle.

Furthermore, fuel-injection valves are known wherein, in which the ejection opening, there is a pin which is axially displaceable by means of a holding element so as to be able to adjust the feed of fuel. Special measures for the improvement of the atomization are not provided therein.

SUMMARY OF THE INVENTION

The object of the present invention is to provide an electromagnetically actuatable fuel-injection valve in which good atomization is assured.

This object is achieved in accordance with the invention in the manner that the conical region does not extend beyond a plane formed by the outer edge of the ejection opening.

The electromagnetically actuatable fuel-injection valve of the invention is advantageous in that the layer of fuel which flows along the wall of the ejection opening is destroyed before reaching the edge by small elements which extend from the conical portion of the pin. This prevents detachment of the layer of fuel flowing along the edge in the form of large drops. In particular, in injection systems in which fuel is injected into an intake port within a region of the throttle valve, good atomization of the fuel and, at the same time, a hollow spray cone are thereby obtained.

A further feature of the invention provides that the ejection opening is developed conically in an outer region, the conical regions of the pin and of the ejection opening being so developed that the free cross section decreases in the direction towards the outer edge of the ejection opening. Another feature is that the angle formed by the outer surface and an axis of the conical region of the pin is greater than the aperture angle of the conical region of the ejection opening. In this way, an accelerating of the fuel during its passage through the ejection opening is obtained, which, in turn, contributes to better atomization.

Another feature of the invention is that the conical region of the pin is shorter in axial direction that the conical region of the ejection opening. In this connection one special development resides in the fact that the generatrices of the conical region of the pin intersect the wall surface of the conical region of the ejection opening in the vicinity of the outer edge. In this way, the result is obtained that the particles of liquid which detach themselves from the surface of the conical part at its edge are thrown by the radial component of their velocity, or, in the case of swirl, by the centrifugal force, towards the edge of the ejection opening and interfere there with the formation of a closed flow.

In accordance with another feature of the invention, the pin can be held in a holding element which has at least one borehole. The direction of the borehole can have a tangential component in order to produce swirl.

Finally, the holding element can, in accordance with another feature of the invention, be arranged for axial displacement in the cylindrical region, whereby a simple adjustment of the ejection quantity is simplified. One embodiment of this feature provides that both the cylindrical region of the ejection opening and the holding element are provided with a thread.

This embodiment contributes substantially to a simple and economical manufacture of the fuel-injection valve of the invention.

BRIEF DESCRIPTION OF THE DRAWINGS

The invention permits of numerous embodiments. One of them is shown diagrammatically in several figures of the drawing and will be described below. In the drawing.

Identical parts are provided with the same reference numbers in the figures.

DETAILED DESCRIPTION OF THE PREFERRED EMBODIMENT

Figure 1:
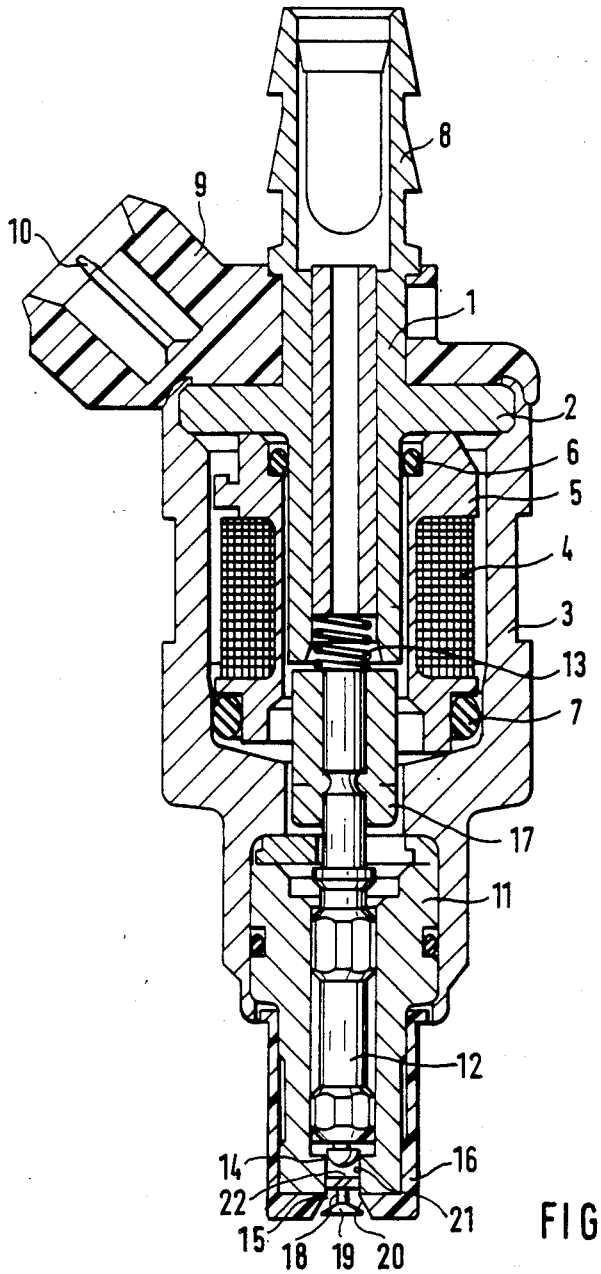
FIG. 1 is a section through a fuel-injection valve.

In the fuel-injection valve shown in FIG. 1, a tube 1, a flange-like part 2 of the tube 1 and a housing 3 form a magnetically conductive core for a magnet coil 4 which is supported on a coil form 5. Between the winding form 5, on the one hand, and the tube 1 and housing 3 on the other hand, packings 6, 7 are provided.

An extension 8 of the tube 1 serves as connection for the fuel line. A plastic member 9 together with a contact 10 forms an electric connection for the magnet coil 4.

In a guide part 11 there is supported a valve needle 12 which is pressed by the lower part of a coil spring 13 against a valve seat 14. The valve seat 14 is part of an ejection opening 15 which is provided in the guide part 11 and is continued in an opening in the cap 16.

On that end of the valve needle 12 which faces away from the ejection opening 15 there is provided an armature 17 which, when current flows through the magnet coil 4, is pulled, in opposition to the spring force, towards the tube 1 to open the valve.

The ejection opening 15 has a conical region 20 and a cylindrical region 21. A holding element 18 for a pin 19 is present within the cylindrical region 21. The holding element 18 has one or more boreholes 22 which preferably are angled relative to an axis of the tube 1 to have a tangential component.

Figure 2:
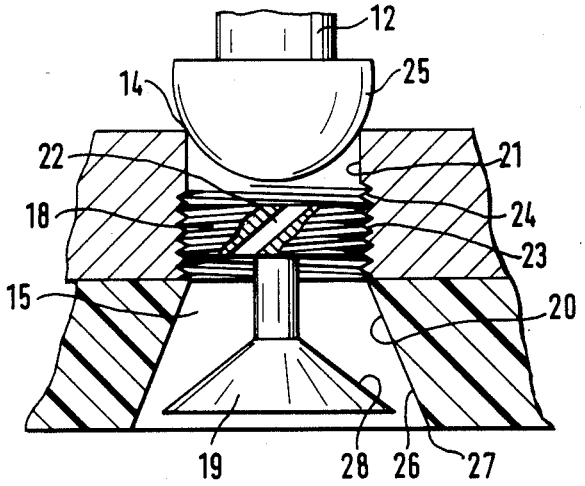
FIG. 2 is an enlarged view of the region of the ejection opening.

FIG. 2 shows the region of the ejection opening 15 on a larger scale. In the embodiment shown in FIG. 2, the holding element 18 is screwed by means of a thread 23 into the cylindrical region 21 of the ejection opening 15, which region also has a thread 24. By turning the pin 19, the axial position of the holding element 18 and of the pin 19 can thus be precisely adjusted. In known fuel-injection valves the stroke of the valve needle 12 plays a large part in determining the amount of fuel which will be fed upon one stroke. It is therefore necessary in the case of the known valves to maintain the quantity of fuel to be fed by narrow tolerances of corresponding parts of the fuel-injection valve, and by additional remachining of the valve after it has already been assembled. This remachining consists, for instance, in regrinding the valve bore and is time-consuming and therefore cost-intensive.

In the case of the fuel-injection valve shown in FIG. 2, however, the static throughput in the region of the working stroke of the valve needle 12 is relatively independent of this stroke, as a result of a curved characteristic curve. The curvature of the characteristic curve results from the fact that, in the case of small strokes the annular slot which is opened between a closure element 25 and the valve seat 14 opposes the greatest resistance to the flow of fuel while, with larger strokes, the flow resistance of the annular slot present between the pin 19 and the conical wall of the ejection opening 15 predominates.

Despite the swirl of the fuel in the ejection opening 15 produced by the oblique borehole 22, a closed flow is obtained on the wall 26 of the region 20 of the ejection opening 15, which, without the measure of the invention, can lead to relatively large drops forming on the edge 27 and dropping off from the edge. This is prevented by means of the conical region 28 of the pin 19. The liquid particles which move downward on the outer surface of the pin 19 and detach themselves from the edge of the conical region 28 are thrown in the direction towards the wall 26 of the conical region 20 of the ejection opening 15. There they disturb the closed flow which flows along the wall 26 and thus prevent the formation of larger drops at the edge 27.

I claim:

1. An electromagnetically actuatable fuel-injection valve for injection systems for internal-combustion engines, the valve comprising:

a valve housing having an ejection opening, the opening being formed about a central axis;

a magnet winding disposed within said housing;

an armature magnetically coupled to said magnet winding;

a closure element connected to said armature; and a pin which is located in and coaxially to the ejection opening, the pin having a convex conical region facing inwardly toward the ejection opening, the outer region of said ejection opening being formed with a conical concave surface enlarging in the flow direction of the fuel; and wherein the cone angle of the surface of the conical region of said pin is greater than the cone angle of the conical region of said ejection opening to provide that the space bounded by the conical regions of said pin and of said ejection opening decreases in cross section in a direction towards an outer edge of the ejection opening; and wherein said conical region of said pin extends to a plane behind or coinciding with a plane located at an outer edge of said ejection opening.

2. An electromagnetically actuatable fuel-injection valve according to claim 1, wherein the conical region of said pin is shorter in axial direction than the conical region of said ejection opening.

3. An electromagnetically actuatable fuel-injection valve according to claim 1, wherein the generatrices of the conical region of said pin intersect a wall surface of the conical region of said ejection opening in the vicinity of the outer edge of said ejection opening.

4. An electromagnetically actuatable fuel-injection valve according to claim 1, further comprising a holding element which has at least one borehole; and wherein said pin is secured in said holding element; and wherein the direction of said borehole is inclined relative to an axis of said pin to provide a tangential component to said borehole direction.

5. An electromagnetically actuatable fuel-injection valve according to claim 1, wherein said holding element is secured adjustably in axial direction within a cylindrical region of said ejection opening.

6. An electromagnetically actuatable fuel-injection valve according to claim 5, wherein the cylindrical region of said ejection opening and said holding element are each provided with a thread.

* * * * *